US006454880B1

(12) United States Patent
Rickman, Jr.

(10) Patent No.: US 6,454,880 B1
(45) Date of Patent: Sep. 24, 2002

(54) MATERIAL FOR DIE CASTING TOOLING COMPONENTS, METHOD FOR MAKING SAME, AND TOOLING COMPONENTS MADE FROM THE MATERIAL AND PROCESS

(76) Inventor: Herbert (Lonny) A. Rickman, Jr., 3337 Hunter, Royal Oak, MI (US) 48073

( * ) Notice: Subject to any disclaimer, the term of this patent is extended or adjusted under 35 U.S.C. 154(b) by 0 days.

(21) Appl. No.: 09/676,731

(22) Filed: Sep. 29, 2000

Related U.S. Application Data

(60) Provisional application No. 60/156,543, filed on Sep. 29, 1999.

(51) Int. Cl.[7] ..... C22C 38/12; C22C 38/04; C23C 8/32

(52) U.S. Cl. ..... 148/319; 148/218; 148/219; 148/334

(58) Field of Search ..... 148/218, 219, 148/319, 334

(56) References Cited

U.S. PATENT DOCUMENTS

| | | | | |
|---|---|---|---|---|
| 3,615,880 A | | 10/1971 | Barto et al. | |
| 3,685,572 A | | 8/1972 | Carver et al. | |
| 4,119,443 A | * | 10/1978 | Abe et al. | 148/219 |
| 4,563,223 A | * | 1/1986 | Dawes et al. | 148/218 |
| 4,667,729 A | | 5/1987 | Zecman | |
| 4,704,079 A | | 11/1987 | Pluim, Jr. | |
| 4,733,715 A | | 3/1988 | Matsuzaki et al. | |
| 4,886,107 A | | 12/1989 | Zecman | |
| 5,697,422 A | | 12/1997 | Righi et al. | |
| 5,711,364 A | | 1/1998 | Ota et al. | |
| 5,810,067 A | | 9/1998 | Atari, et al. | |

OTHER PUBLICATIONS

Maeda, Toshio et al., Japanese abstract JP405148535A dated Jun. 15, 1993.*

* cited by examiner

*Primary Examiner*—Deborah Yee
(74) *Attorney, Agent, or Firm*—Dykema Gossett PLLC

(57) ABSTRACT

Multi-layer material for die cast tooling component includes a low to medium carbon steel with alloying amounts of vanadium, manganese and molybdenum, quenched to at least 10 Bar and nitrocarburized to achieve a multiple layer structure with at least an outside lubricious layer, retaining hardness in the core. The method for producing the multi-layer material includes alloying the core material, forming into desired net shape, quenching and nitrocarburizing. A high endurance die cast tooling component for use in tooling applications includes a core material of at least 80 percent by volume martensite with no more than 15 percent by volume of retained austenite with at least two surface layers for lubricity and endurance. The tooling components may include shot sleeves, plungers, plunger tips, bushings, and core pins.

20 Claims, 2 Drawing Sheets

MATERIAL FOR DIE CASTING TOOLING COMPONENTS, METHOD FOR MAKING SAME, AND TOOLING COMPONENTS MADE FROM THE MATERIAL AND PROCESS

CROSS REFERENCES TO RELATED APPLICATIONS

This application claims the benefit of U.S. Provisional Application No. 60/156,543 filed on Sep. 29, 1999.

FIELD OF THE INVENTION

The field of the present invention relates to materials for tooling components, including shot sleeves and/or cold chambers used in nonferrous die casting. More particularly, the present invention relates to tooling components exhibiting oxidation and "washing" resistance, as well as the process for the manufacture thereof.

BACKGROUND OF THE INVENTION

Conventional non-ferrous die casting is the method used for molding aluminum, magnesium and zinc parts. Usually the dies are made of steel, with inlets to receive the material to be formed into a part. The inlet of the steel die is connected with a tubular element typically referred to as the shot sleeve or hot/cold chamber. The hot/cold chamber (hereinafter simply referred to as a shot sleeve) receives the molten metal material which the casting or molded part is to be made from. Typically the shot sleeve chamber is oriented in a horizontal fashion with a hole for receiving the molten metal along its cylindrical side oriented vertically upward. A plunger with a sealing head tip is slidably mounted within the shot sleeve. The plunger creates pressure in the shot sleeve, injecting the molten material into the die cavity. The shot sleeve, plunger and plunger tip are all considered to be perishable tooling components which need to be replaced after appropriate cycles. Additionally, core pins in the mold for forming cavities within the molded article are also considered perishable. Prior to the present invention, most shot sleeves and other perishable tooling were manufactured from H-13 and premium H-13, hot working tool steel per NADCA, "North American Die Cast Association" standard 207-97 (NADCA 207-97 type material). NADCA 207-97 identifies and specifies base material chemistry, micro cleanliness and inclusion ratings and impact and fatigue properties for H-13 raw material.

A chart approximating typical prior alloy constituents for a conventional H-13 steel is provided below, percentages being represented by weight.

| Element | Upper Spec Limit % | Lower Spec Limit % |
|---|---|---|
| Carbon | .4 | .3 |
| Manganese | .4 | .3 |
| Silicon | 1.2 | .8 |
| Chromium | 5.5 | 4.7 |
| Molybdenum | 1.75 | 1.2 |
| Vanadium | 1.2 | .8 |

The material is first annealed to increase its formability, and then forged to near net shape or is optionally machined. Then it is heated and quenched and tempered per HRC 44-48 standard, followed by finishing. The finish machine operation typically includes cross matching which is intended to facilitate the movement of carbon based lubricant along the length of the cold chamber.

Prior art methods for making the conventional tooling components are as follows: The prior art tools were first heated in accordance with NADCA recommendations to a predetermined temperature in a near vacuum (approximately −29.8" of Mercury). An electric furnace allowed the temperature to be elevated while a vacuum was maintained. The furnace was brought to and maintained at a temperature of 1200° F. The furnace was then partially pressurized to 500 microtorr with nitrogen, or any other appropriate inert or substantially inert gas. The temperature was then ramped up to 1550° F. The temperature was then subsequently raised to 1875° F. for a predetermined period of time to form surface and core austenite. The tools were then quenched in an inert or substantially inert gas such as nitrogen which is used to pressurize the chamber to 10 Bar (135 pounds per square inch) of pressure and was circulated through the chamber and past a heat exchanger. The temperature was then brought down in stages in an effort to obtain optimum hardenability and impact or fatigue properties while minimizing product distortion, grain growth and carbide particle size/micro chemistry segregation. The quenching was controlled to insure a minimum cooling rate of fifty degrees Fahrenheit per minute. Other prior quenching methods have included cyanide-treated salt quench, 2 Bar quench, 4 Bar quench and similar variations, with each method having its inherent problems and/or traits which ultimately contribute to reduced tool performance.

Conventional tips/plungers were formed of a beryllium-copper composition due to the thermal properties of that material. As beryllium is a heat resistant constituent added to the non-ferrous copper alloy, the molten process metal did not solidify before it was mechanically pushed into the die cavity. The properties of the tip/plunger were also selected to insure consistent thermal expansion and contraction so that the molten metal bleed by and premature wear through friction are minimized.

FAILURE MODES OF PRIOR ART

Prior art cold chambers and core pins experienced soldering, heat checking, sticking, spalling, galling, erosion and inter-granular failure. Beryllium-copper tips or plungers exhibit spalling, galling and pitting since they are typically much softer than the materials used for the cold chamber. Soldering is a solidification of the molten magnesium, aluminum or zinc on the die cast tooling components. Heat checking means the beginning of or incipient inter-granular failure on the die cast tooling components. Inter-granular failure is the complete failure of the die cast tooling or components and includes cracking, splitting, burst, etc. Spalling, galling or pitting is defined as premature wear due to the sliding wear of any die cast tooling component. Erosion means the wearing away of the base material due to pressure and temperature of the molten die cast metal.

QUALITY AND ENVIRONMENTAL ISSUES OF PRIOR ART

Die casters usually use carbon or molybdenum-based die lubricants to reduce friction between the perishable components that slide together, such as the plunger tip and the shot sleeve. These lubricants become airborne, thus coating surrounding walls and floors of the die casting equipment. In order to decrease operator exposure to the airborne particles, scrubbers and air exchange systems are commonly employed. While scrubbers may reduce the worker's health concerns it does not eliminate all housekeeping and residual exposure concerns. In addition, the lubricant may cause voids or porosity in the finished product. Die cast industry estimates place the associated porosity defects as high as 6 percent of the total product manufactured in die cast machines of non-ferrous metals.

Beryllium-copper components require a clean room environment for their fabrication, complete with operator safety equipment such as breathing apparatus and protective clothing, so that the operator does not come into external or internal contact with the beryllium. It has been determined that exposure to beryllium, even in small amounts of less than 25 ppm (parts per million), can contribute to a spectrum of health problems up to and including terminal illness. In addition, beryllium-copper plungers are much softer than the shot sleeve, so any variation in fit and function results in extensive wear or spalling or galling of the plunger.

Material Selection of Prior Art

Ferrous metal tooling material has been conventionally selected by manufacturers and producers for its machinability, availability, hardenability, cost, formability, quality and suitability for specified design requirements. Tool design variables may include material hardenability, material chemistry, tool cross section, material tensile strength, yield, elongation (ductility) and reduction in area. Some of these variables interact with each other. For example, hardenability is largely a function of the chemistry of the steel, but is also a function of tool cross section. Past practices have identified H-13 as the material of choice for shot sleeves. However, H-13 steel is relatively expensive when compared with low alloy and plain carbon steels. The North American Die Cast Association has determined that a Rockwell hardness of 46–50 is optimum for shot sleeves, since H-13 at that hardness is sufficiently heat resistant and has desirable wear characteristics. It is also known to use H-11 alloys. H-11 steel has amounts of carbon, chromium, and molybdenum similar to those of H-13 steel. Although the aforementioned steels are acceptable, it would be desirable to provide a new steel which will increase tooling life and which additionally can be fabricated from a cheaper base steel or low alloy due to the cost of high alloy steels.

SUMMARY OF THE INVENTION

In accordance with the above-mentioned advantages being sought, the present invention provides a new micro-alloy steel for use as perishable die cast tooling components, the method for making them, and the products which result from that process. Disclosed is a multi-layer material for die cast tooling components which includes a low to medium carbon steel, with from about 0.001 to about 0.15 vanadium constituent, percentage by weight of resultant material, from about 0.5 to about 2.0 magnesium constituent, percentage by weight of resultant material, and from about 0.15 to about 0.75 molybdenum, percentage by weight of resultant material. This material is quenched to at least 10 Bar. The quenching may be accomplished by oil quenching, salt quenching, air or compressed nitrogen quenching, fluidized bed quenching, or any other well-known method for quenching the material. Thereafter, an optional step of tempering the material to any desired hardness, but not below 950, may prove to be advantageous.

This yields a material which has at least two layers adhered to the core material. The first, or outer, layer is an oxide layer, and generally includes a blue oxide layer having a dimension of from about 0.0001" to about 0.0005" in thickness. The intermediate layer includes at least one white layer of iron epsilon, particularly $Fe_3O_4$.

The material may also be nitrocarburized in an atmosphere containing at least ammonia and methane at a temperature of at least 700° F. In this instance, a carbon-nitrogen enriched phase or diffusion layer may also result between the white layer and the core material due to the nitrocarburization. This results in a material that has a lubricious surface, while retaining hardness in the core.

Further disclosed is a method for producing a multi-layer material for die cast tooling components, comprising the steps of alloying a low to medium carbon steel with at least three additional constituents, including 0.001 to 0.15 pbw vanadium, 0.5 to 2.0 pbw manganese, and 0.15 to 0.75 pbw molybdenum, and thereafter forming that steel into a desired tooling component near net shape. The tooling component is then quenched to at least 10 Bar, followed optionally by nitrocarburizing. An optional intermediate step may include tempering the tool component between the quenching and nitrocarburizing step.

A high endurance die cast tooling component for use in tooling applications is also disclosed having at least 80 percent by volume of martensite with no greater than 15 percent retained austenite, and having at least an outer and an inner surface layer extending outwardly in all directions from the core. The outer layer is an oxide layer and the inner layer is at least one white layer of iron epsilon. In another embodiment, a third layer next to the core may be present, and it would be a diffusion layer of a carbon and nitrogen enriched phase. The appropriate die cast tooling components made in accordance with the present invention include shot sleeves for both hot and cold chamber applications, plungers, plunger tips, bushings, and core pins.

The high endurance die cast tooling components made pursuant to the present invention have been tested and have been found to exhibit beautiful resistance to oxidation and washing, and exhibit high endurance when compared to the prior art methods. Conventional tooling components do not withstand a very long lifetime. For example, a shot sleeve made in accordance with the present invention exhibited a cycle life of more than 235,000 shots, whereas the best prior art shot sleeves had a cycle life of 50,000 shots.

Having summarized my invention above, now we will look at further detail of the various aspects of the invention below. The drawing is merely illustrative and should not be construed as a limit on my invention.

DETAILED DESCRIPTION OF THE INVENTION

Figure 1:
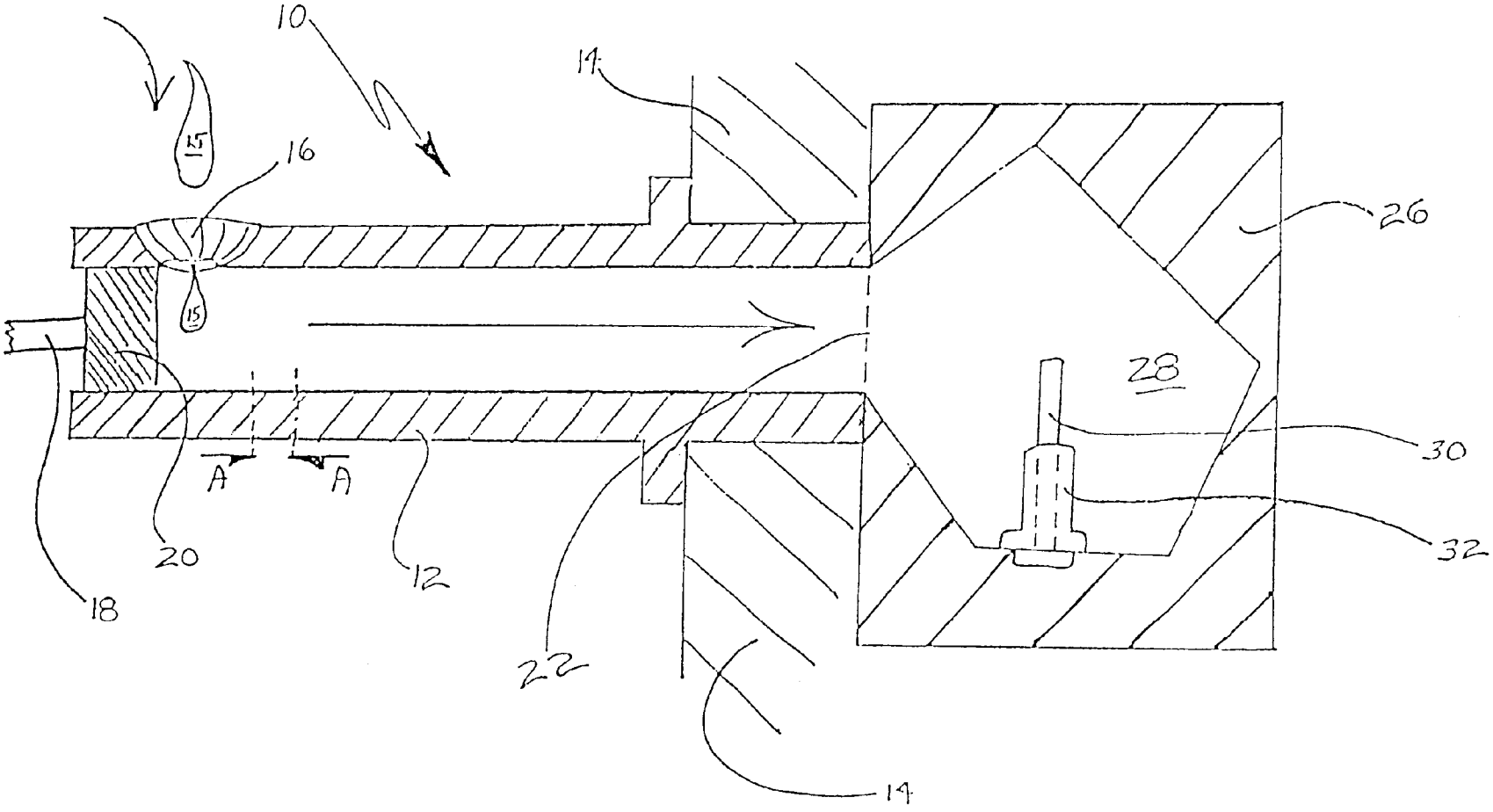
FIG. 1 illustrates an exemplary set of tooling components in relation to one another as is conventional in the industry.

As discussed above, the tooling components utilized in die casting of non-ferrous materials are perishable, in that they become non-functioning after repeated use and need to be replaced after a cycle time of a relatively short number of shots of material. Also as discussed above, it would be advantageous for the creation of a new material to make the tooling components, such that the cycle time could be greatly increased, thereby alleviating down time and the time and expense for installing new tooling components. In accordance with these advantages, the present invention discloses a new multi-layer material for die cast tooling components, processes for manufacturing that material, and the products which are made from that material by that process.

Further, in accordance with the above-mentioned advantages being sought, the present invention provides a new micro-alloy steel for use as the perishable die cast tooling components, which can be fabricated from low carbon or medium carbon steels such as AISI/SAE 4140 through AISI/SAE 4150 or plain carbon AISI/SAE 1018AK, either alone (if there is a sufficient amount of desired trace elements) or along with additional metallic constituents, including vanadium, molybdenum and manganese. In one embodiment of the present invention, it is preferred that the steel have trace amounts of vanadium in the range of from about 0.001 to 0.15 percent by weight. Other embodiments of the preferred steels have amounts of chromium and molybdenum, which differ from those of conventional die steels, such as a standard H-13 steel. One of the preferred materials is a micro-alloying steel having vanadium as a micro-alloying element. A possible AISI/SAE grade designation for such a steel might be 15V31 Modified. The steel should be aluminum killed.

The multi-layer material of the present invention finds particular usefulness with regards to various die cast tooling components, such as the hot or cold chamber (generically referred to as the shot sleeve), the plunger, the plunger tip, and/or core pins. Needless to say, any of the tooling components which are utilized in die casting of non-ferrous materials may find advantage by being made of the present material. Low to medium carbon steels, such as those described hereinabove, are especially applicable when they are alloyed with micro- constituents of vanadium, manganese and/or molybdenum. The vanadium should be present in amounts from about 0.001 to about 0.15, manganese 0.52 to about 2.0, and molybdenum 0.15 to about 0.75, all expressed as percentages by weight of the resulting material. Experiments have been performed within these ranges, and have shown positive results.

After the material has been formed into a near net shape of a desired tooling component, it is then quenched to at least 10 Bar by various known methods, including, but not limited to, hot oil quenching held at a temperature of 240° F., salt quenching at 420° F., air or compressed nitrogen quenching, fluidized bed quenching, or any other known method. Depending upon the application and the material makeup, the component may then be desirably tempered to any desired hardness, although not below 950.

The vanadium has been added to increase the endurance of the tool component, while the manganese count is desirable for the hardenability, not unlike the 1500 series of steel. Molybdenum is added as a nitride enhancer, to help during the further step of the ferritic nitrocarburizing of the tooling component itself.

Thereafter, the tooling component may be subjected to nitrocarburization in an atmosphere containing at least ammonia and methane at a temperature of at least 800° F., although preferably the nitrocarburization takes place at approximately 1150° F. Nitrocarburization occurs in a fluidized sand bed having alumina particles because they provide a high heating transfer rate. Note that the nitrocarburization is done at a temperature where tempering tends to occur, thereby forming iron-nitrogen-carbon compounds at the surface. Such a method has been perfected by Dynamic Metal Treating, Inc., of Canton, Mich.

By following this method and making this material, a tooling component is formed which generally has a core microstructure of at least 80 percent martensite with no greater than 15 percent retained austenite. There is also formed an outer and an inner surface layer extending outwardly in all directions from the core. The outer layer is an oxide, and is generally found to be a blue oxide layer which has a thickness of from about 0.0001" to about 0.0005". This oxide layer is a lubricity enhancer, and reduces resistance for the plunger tip as it slides in and out of the shot sleeve. The inner layer includes at least one white layer of iron epsilon. Generally, this material is not a gamma phase, although it does have lower compressive residual stresses. The apparent hardness Vickers is approximately 1,400 Hv. This layer is from about 1 micron to about 0.002" thick. In some of the instances, a second white layer is formed that is no more than 0.0006" maximum.

If the added step of nitrocarburizing is performed, then a third layer occurs which forms an inner layer including a diffusion layer of carbon and nitrogen enriched phase material. This layer has a thickness from about 0.0013" to 0.018".

The white layer is usually a compound layer made of $Fe_3O_4$, a compound which is ceramic-like in nature. It is quite ductal and can bend nearly 90° without cracking. If the optional step of tempering was performed, the higher temperature may form the optional second white layer. This second white layer may be a layer of cementite which usually forms at approximately 1150° F., although this layer apparently forms at a lower temperature when it is involved in this composition. The second white layer may also be a form of a carbonitrided, non-brittle phase which can be formed under certain tempering conditions.

Figure 2:
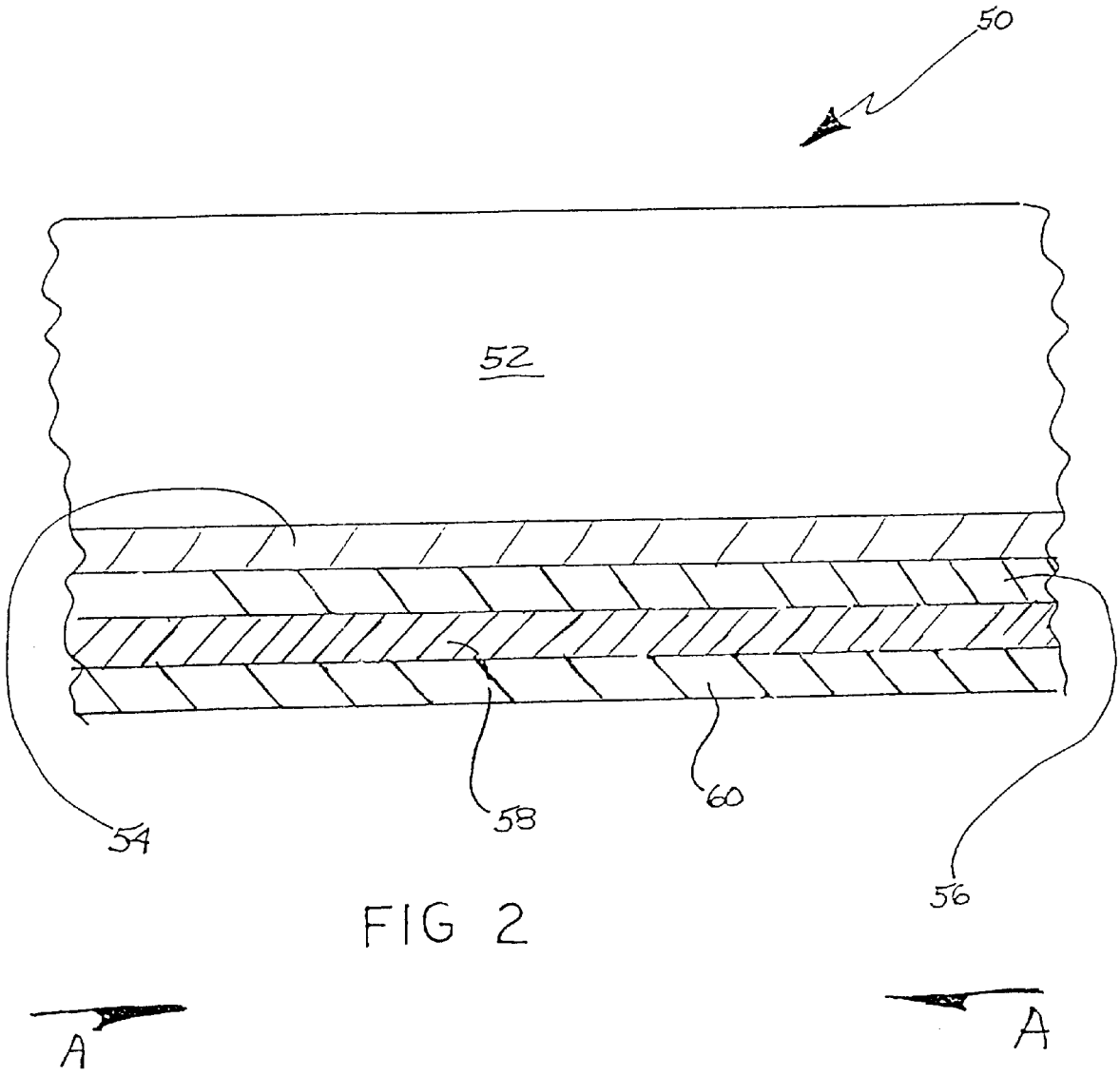
FIG. 2 is a side elevational view of a cutaway portion of a shot sleeve made in accordance with the present invention, including all preferred embodiments.

Looking now to FIG. 1, there is shown a general illustration of tooling components in their respective locations. Although they are generally denoted by the numeral 10, a shot sleeve 12 is shown as a cold chamber in this instance, butting up against die cast machine 14. Shot sleeve 12 has an aperture 16 through which molten metal 15 may be introduced. Plunger rod 18 includes a plunger tip 20 for pressurizing the molten metal and forcing it through opening 22 into die 26. Die 26 has a die cavity 28 in which bushing 32 holds core pins 30 in place. Core pins are usually placed in a mold before injection and are used to create cavities. The core pins are removed after the casting. The displacement of the plunger forces molten metal into the die 26, thereby making a casting. All of the components illustrated, shot sleeve 12, plunger rod 18, plunger tip 20, bushing 32, and core pins 30 may be advantageously made of the material of the present invention to increase the endurance of those tooling components. Looking next to FIG. 2, there is generally shown a cutaway portion of the bottom of the shot sleeve of FIG. 1 along lines A—A. The cross-sectional side elevational view of the shot sleeve is generally denoted by numeral 50, and includes core material 52 having the inner most layer, the diffusion layer 54, directly adjacent to the core material 52. Cementite layer 56 is directly adjacent the diffusion layer 54, and comprises cementite, if the proper temperature conditions have been met, as in this preferred embodiment. Cementite forms at approximately 1100° F. Intermediate layer 58 is a layer of iron epsilon phase material, although it is not gamma prime material. The outer most layer 60 is shown in direct contact with intermediate layer 58, and includes an iron oxide which is preferred for cold start break-in and lubricity.

Looking again to FIG. 2, we will now describe each layer and discuss its individual properties in the order in which they appear from the outer layer toward the core. Outer most layer 60 is an iron oxide layer, as discussed above, with a typical range of thickness from about 0.0001" to about 0.0005" (0.0025 to 0.012 mm). Intermediate layer 58 comprises an iron epsilon phase material having a typical range of from about 0.0001" to 0.002" (0.0025 to 0.05 mm), with a preferred value of from about 0.0007" to 0.0014". The preferred hardness is up to 1400 Hardness Vickers for this particular material. If present, second white layer 56 is a cementite material which is typically formed at temperatures in excess of 1100° F. (643° C.), with a Rockwell C value of 40 to 50 equivalent, and a thickness of up to 0.0006". The inner most layer 54 is a carbon-nitrogen enriched diffusion zone having a preferred thickness of about 0.0013" (0.033 mm) up to about 0.018" (0.457 mm). The hardness is preferably 10 points HRc greater than the base material hardness. In this particular instance, where the base material substrate has a micro-alloy hardness of about HRc 35 when tempered at 1150° F., then layer 54 would have a HRc value of 45.

The core hardness of the base material substrate is a function of the chemistry of the constituent steel, the cross-sectional dimension, the austenitizing temperature, the quench severity, the quench down rate, as well as the tempering temperature. For the preferred embodiment, the HRc value of the base material substrate is approximately 35. The austenitic-ferritic nitrocarburizing was performed at normal operating temperatures of between 700° F. to 1450° F. (421° C. to 838° C.) with a preferable range of from about 950° F. to 1150° F. (560° C. to 760° C.).

When practicing the preferred embodiment of the present invention, the precursor low to medium carbon steel may be annealed and then formed into its desired shape by forging and/or machining. Although the base material core hardness is not believed to be a critical parameter, the surface hardness is one characteristic of primary importance. This is accomplished by hardening the tool at a temperature of 1575° F. to 1625° F. and then oil quenching. The quench oil specification is preferably a highly agitated commercial quench oil maintained at 180° F. The rate of temperature decrease with the oil quench should be at least approximately 200° F. per minute. The oil quench is believed to decrease the amount of retained austenite and untempered martensite in the cold chamber.

After quenching the tool component, it may be tempered to 1200° F. to obtain a tempered martensitic structure if a 4100 series steel was used. If the proposed 15V31 Modified steel is employed, it is anticipated that a tempering temperature higher than 1200° F. may be required. It is desired to "push" the tempering temperature as close to the critical or austenitizing temperature as possible without altering the desired tempered martensitic structure. The theory or belief motivating the tempering temperature specification is that taking the base material's temperature to a value greater than the process temperature of the die cast operation makes the base material more heat resistant.

For maximum performance, porosity of the surface of any of the tooling components can greatly affect the lifetime of that tool. Some of the tooling components are more sensitive to that than others. In order to minimize porosity on the inside of a shot sleeve, the inside bore of the shot sleeve should be honed to a micro finish Ra factor of 8 or less. The smoother the finish, the better.

The shot sleeve is then subjected to ferritic nitrocarburizing at 1150° F. to 1175° F., which is below the austenitic nitrocarburizing temperature, although above the typical ferritic nitrocarburizing temperature.

With die components made according to the present invention, the need for lubrication can be greatly reduced or eliminated. The nitrocarburizing helps to hold porosity of the tooling component surface coating to under 20 percent and typically provides a coating of 0.001" to 0.002" on the item.

Appropriate specifications for nitrocarburizing, including the fluidized bed processing, the time, the temperatures and atmospheres are readily apparent to those skilled in the art of heat treating of steels, and are not critical to this invention.

The surface of the tooling component thus treated provides an intermediate compound white layer of iron epsilon phase material of $Fe_3O_4$, an apparent hardness of 800–1200 $H_v$ and above, and a thickness of from about 0.001" to about 0.002" with less than 25 percent porosity, and preferably less than 20 percent porosity. The surface also has a carbon and nitrogen diffusion zone greater than 0.018". The core microstructure is 90 percent or more tempered martensitic microstructure with less than 5 percent retained austenite when evaluated visually, but less than 10 percent when evaluated with x-ray diffraction. The surface is file hard per SAE J864, 65 minimum.

An exemplary specification for the preferred material of the steel is shown in the table below:

| Element | Upper Spec Limit | Lower Spec Limit |
|---|---|---|
| Carbon | .35 | .28 |
| Manganese | 1.60 | 1.35 |
| Phosphorous | .04 Max | N/A |
| Sulfur | .035Max | N/A |
| Silicon | .15 | .02 |
| Chromium | 1.00 | .70 |
| Molybdenum | .30 | .15 |
| Vanadium | .10 | .06 |
| *Aluminum | .35 | .15 |

*Aluminum will be used as the grain refining element

Another exemplary specification for an especially desirable preferred embodiment for the material of the steel is shown in the table below:

| Element | Upper Spec Limit | Lower Spec Limit |
|---|---|---|
| Carbon | .43 | .38 |
| Manganese | 1.0 | .75 |
| Silicon | .35 | .25 |
| Chromium | 1.10 | .80 |
| Molybdenum | .25 | .15 |
| Vanadium | .10 | .06 |

With these thoughts in mind, the following example shows the increased endurance created by the present invention.

EXAMPLE

For this example, AISI/SAE 4150 low carbon steel was utilized with an addition of 0.008 pbw of vanadium. The manganese content was 1.3 pbw, while molybdenum was approximately 0.23 pbw. The shot sleeve manufactured from this material had a very thin oxide layer, a white layer of 0.0014", and a diffusion layer of 0.024" on the exterior of the core material. Ten shot sleeves were made out of this material and were utilized in the die casting of aluminum parts. The ten shot sleeves averaged approximately 237,000 shots before they needed to be replaced. As discussed above, traditional H13 alloy utilized for shot sleeve components average 50,000 shots prior to needing replacement.

Therefore, the present invention has disclosed a new material, method for making same and tooling components made from that material which are advantageously used in the tooling component industry. While the above description has been illustrative, the invention is only limited by the following claims.

What is claimed is:

1. A multi-layer material for die cast tooling components, comprising:

a low to medium carbon steel;

from about 0.001 to about 0.15 percent by weight of the resultant composition of vanadium constituent;

from about 0.05 to about 2.0 percent by weight of the resultant composition of manganese constituent;

from about 0.15 to about 0.75 percent by weight of the resultant composition of molybdenum constituent;

said material being quenched to at least 10 Bar and said material also being nitrocarburized in an atmosphere containing at least ammonia and methane at a temperature of at least 800° C., whereby the material has at least two layers formed on the exterior of the core of the material, such that lubricity exists on the surface while retaining hardness in the core.

2. The material of claim 1, wherein the vanadium concentration is from about 0.006 to about 0.010 pbw.

3. The material of claim 1, wherein the vanadium concentration is from about 0.06 to about 0.15 pbw.

4. The material of claim 1, wherein the manganese concentration is from about 1.3 to about 1.6 pbw.

5. The material of claim 1, wherein the molybdenum concentration is from about 0.45 to about 0.75 pbw.

6. The material of claim 1, wherein the material is oil quenched in a highly agitated oil at about 180° F. at a rate of at least about 200° F./minute.

7. The material of claim 1, wherein the material is also tempered to form a more enduring material.

8. The material of claim 7, wherein the material is tempered at a temperature of at least 1100° F.

9. The material of claim 1, wherein the material is nitrocarburized at a temperature from about 700° F. to about 1450° F.

10. The material of claim 1, wherein the outermost layer is an oxide layer.

11. The material of claim 1, wherein the outermost layer is from about 0.0001" to about 0.0005" thick.

12. The material of claim 1, wherein the intermediate layer between the outermost layer and the core is at least one white layer of iron epsilon phase material.

13. The material of claim 1, wherein the intermediate layer between the outermost layer and the core is from about 0.0001" to about 0.0002" thick.

14. The material of claim 1, further comprising a diffusion layer of carbon-nitrogen enriched phase material between the intermediate layer and the core of the material.

15. A method for producing a multi-layer material for die cast tooling components, comprising:

alloying a low to medium carbon steel with at least three additional metallic constituents, including vanadium, manganese and molybdenum in small amounts;

forming the alloy into desired near net shapes of the tooling components;

quenching the resultant shaped tooling components to at least 10 Bar; and nitrocarburizing the resultant tooling components to form the multi-layer material.

16. The method of claim 15, wherein the step of quenching is accomplished by a method selected from the group consisting of oil quenching, molten salt quenching, air quenching, compressed nitrogen quenching, and fluidized sand bed quenching.

17. The method of claim 15, further comprising a step of tempering the tooling component at a temperature of at least 1150° F.

18. A high endurance die cast tooling component for use in tooling applications, comprising:

a core material made from a low to medium carbon steel with micro-alloy constituents therein of at least vanadium, manganese, and molybdenum, said core material having a core microstructure of at least 80 percent by volume of martensite with no greater than 15 percent by volume of retained austenite; and at least one outer and one inner surface layer extending outwardly in all directions from the core.

19. The tooling component of claim 18, wherein the said outer layer consists essentially of an oxide, said inner layer consists essentially of a white layer of iron epsilon phase material.

20. The tooling component of claim 18, wherein the tooling component is selected from the group consisting of shot sleeves, plungers, plunger tips, bushings, and core pins.

* * * * *